US007516633B1

(12) United States Patent
Chang

(10) Patent No.: US 7,516,633 B1
(45) Date of Patent: Apr. 14, 2009

(54) ELECTRIC LOCK

(75) Inventor: Jing-Chen Chang, Tou-Liu (TW)

(73) Assignee: EZ Trend Technology Co., Ltd., Chia-Yi County (TW)

( * ) Notice: Subject to any disclaimer, the term of this patent is extended or adjusted under 35 U.S.C. 154(b) by 0 days.

(21) Appl. No.: 12/014,834

(22) Filed: Jan. 16, 2008

(51) Int. Cl.
*E05B 13/10* (2006.01)

(52) U.S. Cl. ..... 70/472; 70/188; 70/223; 70/224; 70/276; 70/277; 70/278.1; 70/279.1; 292/251.5; 292/DIG. 27

(58) Field of Classification Search ..... 70/188–190, 70/276, 413, 277, 278.1, 278.3, 278.7, 279.1, 70/280–282, 149, 422, 472, 218–224; 292/142, 292/144, 251.5, DIG. 27
See application file for complete search history.

(56) References Cited

U.S. PATENT DOCUMENTS 3,785,188 A * 1/1974 Drathschmidt ..... 70/276
4,438,962 A * 3/1984 Soloviff et al. ..... 292/144
4,562,343 A * 12/1985 Wiik et al. ..... 235/382.5
4,625,848 A * 12/1986 Meyers et al. ..... 192/93 A
4,825,992 A * 5/1989 Skrobisch ..... 192/56.4
4,956,984 A * 9/1990 Chi-Cheng ..... 70/277
5,447,047 A * 9/1995 Lin ..... 70/218
5,862,903 A * 1/1999 Gruden et al. ..... 192/105 BB
5,884,515 A * 3/1999 Milman ..... 70/472
5,970,759 A * 10/1999 Trilk ..... 70/277
5,974,912 A * 11/1999 Cheng et al. ..... 70/472
6,145,353 A * 11/2000 Doucet ..... 70/277
6,334,348 B1 * 1/2002 Ming-Chih ..... 70/472
6,418,765 B1 * 7/2002 Chiu ..... 70/279.1
6,471,257 B1 * 10/2002 Lu et al. ..... 292/144
6,517,127 B1 * 2/2003 Lu et al. ..... 292/144
6,807,834 B2 * 10/2004 Tsai ..... 70/472
7,284,745 B2 * 10/2007 Keane et al. ..... 254/372
2002/0144526 A1 * 10/2002 Ming-Chih ..... 70/218
2003/0209042 A1 * 11/2003 Yeh et al. ..... 70/280
2003/0209043 A1 * 11/2003 Yeh et al. ..... 70/280
2004/0089037 A1 * 5/2004 Chang ..... 70/257
2005/0044908 A1 * 3/2005 Min ..... 70/276
2006/0150694 A1 * 7/2006 Frolov et al. ..... 70/277
2007/0051145 A1 * 3/2007 Chang ..... 70/279.1
2007/0169525 A1 * 7/2007 Chang ..... 70/472

* cited by examiner

*Primary Examiner*—Lloyd A Gall
(74) *Attorney, Agent, or Firm*—Panitch Schwarze Belisario & Nadel LLP

(57) ABSTRACT

An electric lock includes a manual operation mechanism and an electric control mechanism. The manual operation mechanism includes a rotary knob unit, a first attracting member mounted fixedly to the rotary knob unit, a key-operated lockset, and a lock-connecting rod connected to and rotatable by the rotary knob unit and the key-operated lockset. The electric control mechanism includes a power source unit, a clutch gear driven by the power source unit to rotate in two directions, and a second attracting member mounted fixedly to the clutch gear. When the clutch gear is driven by the power source unit to rotate to align the first and second attracting members with each other, a magnetic attraction force is generated between the first and second attracting members to allow for co-rotation of the rotary knob unit with the clutch gear.

7 Claims, 8 Drawing Sheets

ELECTRIC LOCK

BACKGROUND OF THE INVENTION

1. Field of the Invention

This invention relates to an electric lock, and more particularly to an electric lock that can be operated either electrically or manually.

2. Description of the Related Art

In US Patent Application Publication No. 2007/0169525, the applicant discloses an electric lock operable either electrically or manually to increase convenience during use. However, protrusions of rotatable members of the electric lock experience fast wear due to frequent contact therebetween, thereby reducing the service life of the electric lock. Furthermore, locking and unlocking of the electric lock cannot be controlled precisely.

SUMMARY OF THE INVENTION

The object of this invention is to provide an electric lock that is durable and that can be locked and unlocked precisely.

According to this invention, an electric lock includes a manual operation mechanism and an electric control mechanism. The manual operation mechanism includes a rotary knob unit, a first attracting member mounted fixedly to the rotary knob unit, a key-operated lockset, and a lock-connecting rod connected to and rotatable by the rotary knob unit and the key-operated lockset. The electric control mechanism includes a power source unit, a clutch gear driven by the power source unit to rotate in two directions, and a second attracting member mounted fixedly to the clutch gear. When the clutch gear is driven by the power source unit to rotate to align the first and second attracting members with each other, a magnetic attraction force is generated between the first and second attracting members to allow for co-rotation of the rotary knob unit with the clutch gear.

As such, since no friction occurs among rotating parts of the electric lock, wearing of the rotating parts can be prevented, thereby increasing the service life of the electric lock and precision in controlling locking and unlocking of the electric lock.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
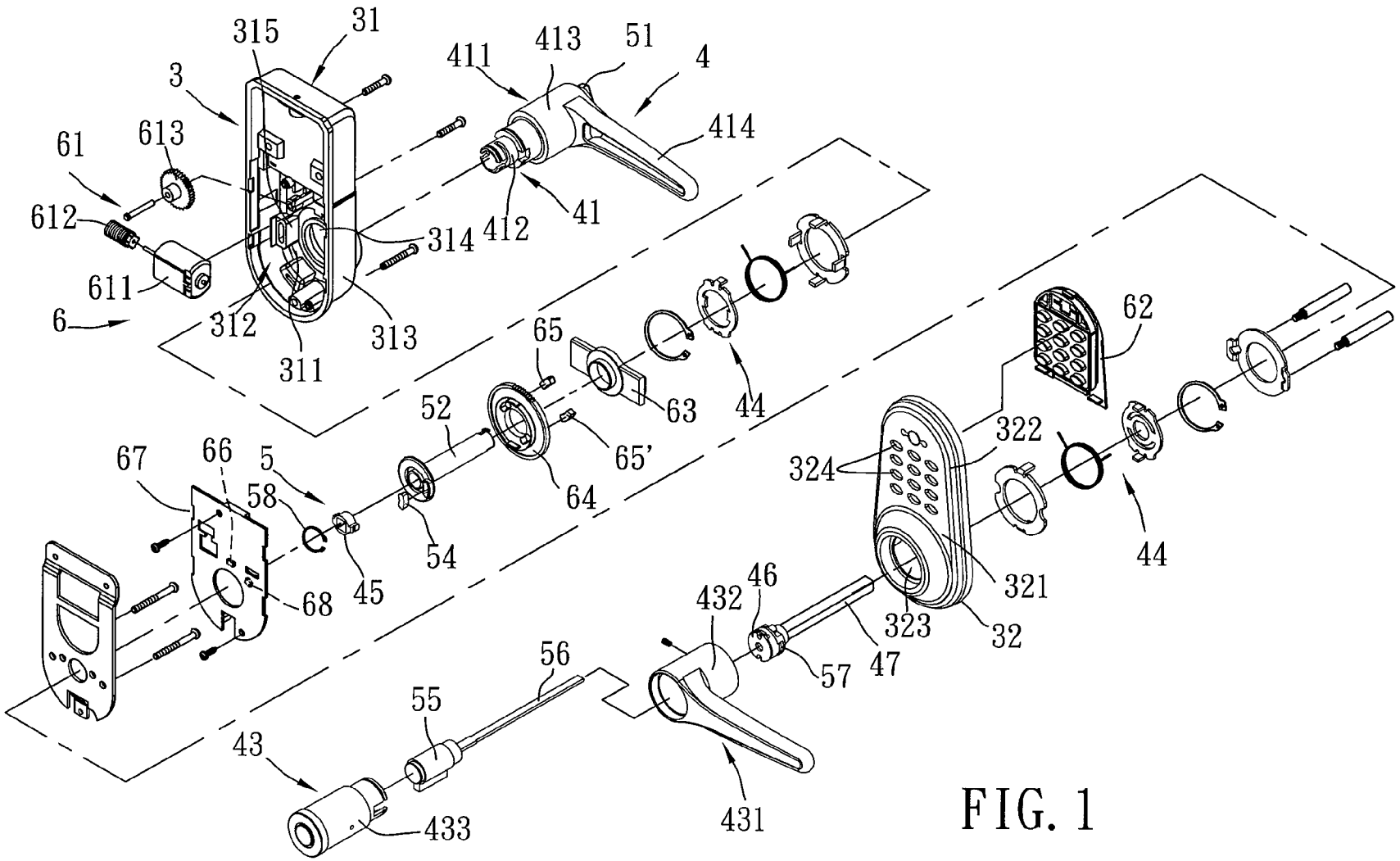
FIG. 1 is an exploded perspective view of the first preferred embodiment of an electric lock according to this invention.
Figure 2:
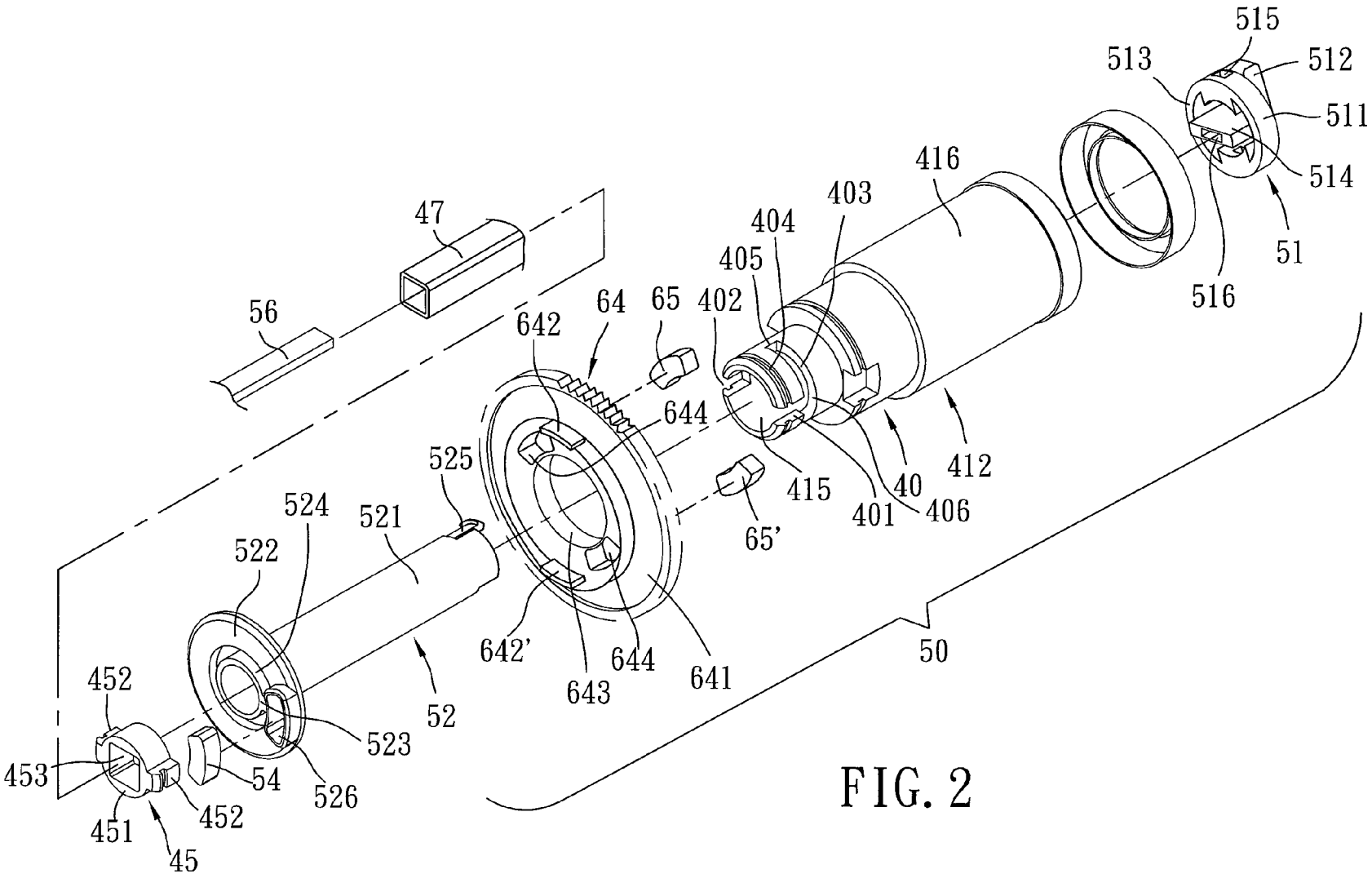
FIG. 2 is a fragmentary exploded perspective view of the first preferred embodiment, illustrating positioning of a hand-operated connecting rod relative to a rotary knob when the electric lock is in an unlocking state.
Figure 3:
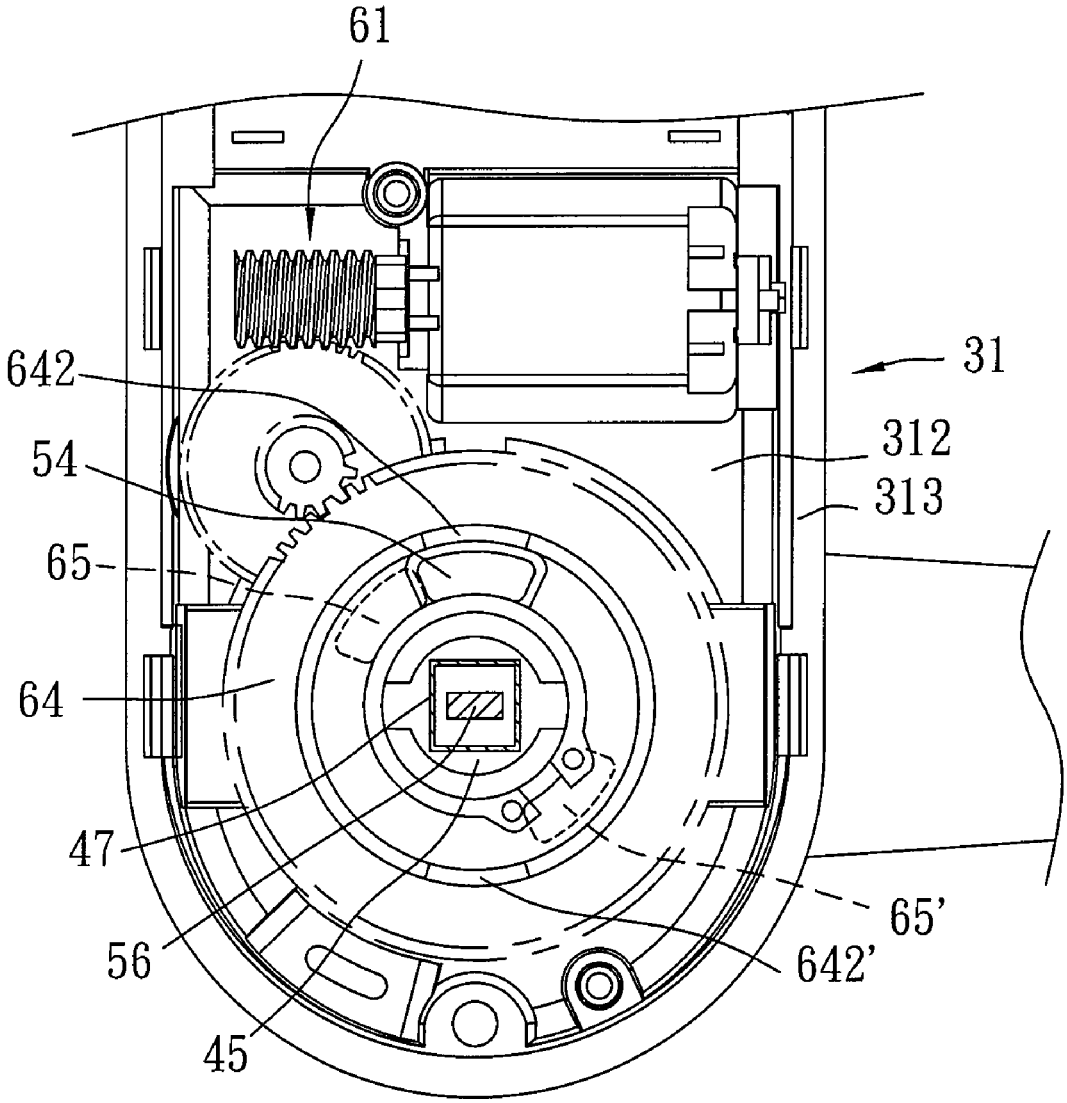
FIG. 3 is a fragmentary schematic side view of the first preferred embodiment in the unlocking state.

Referring to FIGS. 1, 2, and 3, the first preferred embodiment of an electric lock according to this invention is mounted to a door (not shown), and includes a lock housing unit 3, a handle unit 4, a manual operation mechanism 5, and an electric control mechanism 6.

The lock housing unit 3 includes a first lock housing 31 mounted to an inner side surface of the door, and a second lock housing 32 mounted to an outer side surface of the door. The first lock housing 31 has an upright wall 311, and a surrounding wall 313 extending from a periphery of the upright wall 311 toward the door to define an accommodating chamber 312. The upright wall 311 has a circular mounting hole 314 and two mounting blocks 315 (only one is shown in FIG. 1) flanking the mounting hole 314 and extending into the accommodating space 312. The second lock housing 32 has an upright wall 321 and a surrounding wall 322 extending from a periphery of the upright wall 321 toward the door. The upright wall 321 has a mounting hole 323 and a plurality of pushbutton-receiving holes 324 located above the mounting hole 323.

The handle unit 4 includes a first handle 41 disposed rotatably on the first lock housing 31 and extending into the mounting hole 314, a second handle 43 disposed rotatably on the second lock housing 32 and extending into the mounting hole 323, two return units 44 for respectively returning the first and second handles 41, 43, a first connecting seat 45 sleeved on and co-rotatable with the first handle 41, a second connecting seat 46 connected to the second handle 43, and a handle-connecting rod 47 extending into and co-rotatable with the first and second connecting seats 45, 46.

The first handle 41 includes a handle housing 411, and a mounting seat 412 fixed within the handle housing 411. The handle housing 411 has a cylindrical mounting portion 413, and a rotary lever portion 414 extending radially and outwardly from the mounting portion 413. The mounting seat 412 has a surrounding wall 416 defining a mounting passage 415. The surrounding wall 416 has a rotation-limiting portion 40 extending into the accommodating chamber 312. The rotation-limiting portion 40 is formed with diametrically opposed first and second notches 401, 402, a circumferentially extending limiting slot 403 having a first end 405 and a second end 406 that is in spatial communication with the first notch 401, and a ring-engaging groove unit 404 disposed in proximity to an end of the rotation-limiting portion 40.

The second handle 43 includes a handle housing 431 and a mounting seat 433 fixed within a mounting portion 432 of the handle housing 431. The first connecting seat 45 has a central portion 451 extending into the mounting passage 415 in the first handle 41, and two wings 452 extending respectively from two opposite sides of the central portion 451 and engaging respectively the first and second notches 401, 402 in the first handle 41 so as to allow for co-rotation of the first connecting seat 45 with the first handle 41. The second connecting seat 46 is mounted rotatably within the mounting seat 433 of the second handle 43. The handle-connecting rod 47 is configured as a rectangular tube, and extends through a rectangular hole 453 in the first connecting seat 45 and into the second connecting seat 46. The handle-connecting rod 47 can drive a spring bolt (not shown) in a known manner.

The manual operation mechanism 5 includes a rotary knob unit 50 (see FIG. 2), a first attracting member 54 mounted fixedly to the rotary knob unit 50, a key-operated lockset 55 mounted to the second handle 43, a lock-connecting rod 56 connected to and rotatable by the rotary knob unit 50 and the key-operated lockset 55, and an engaging plate unit 57 sleeved on and driven by the lock-connecting rod 56 to allow for or prevent co-rotation of the second handle 43 with the lock-connecting rod 56. The rotary knob unit 50 includes a rotary knob 51 mounted rotatably on the first handle 41, and a hand-operated connecting rod 52 co-rotatable with the rotary knob 51.

The rotary knob 51 includes a disc portion 511, an actuation block 512 extending from the disc portion 511 in a direction away from the first handle 41 and allowing for manual operation, a surrounding wall 513 extending from a periphery of the disc portion 511 in a direction toward the first handle 41, and a hole-defining wall 514 extending from the disc portion 511 in a direction toward the first handle 41. The surrounding wall 513 is disposed around the hole-defining wall 514, and has two hook-engaging slots 515 (only one is shown in FIG. 2) formed radially therethrough. The hole-defining wall 514 defines an insert hole 516. The hand-operated connecting rod 52 has a handle-retaining portion 521, an annular mounting portion 522 disposed around the handle-retaining portion 521, and a connecting portion 523 interconnecting the handle-retaining portion 521 and the annular mounting portion 522 to thereby form a curved slot 524 between the handle-retaining portion 521 and the annular mounting portion 522. The handle-retaining portion 521 is formed with two retaining hooks 525 (only one is shown in FIG. 2) engaging respectively the hook-engaging slots 515 in the rotary knob 51 so as to allow for co-rotation of the hand-operated connecting rod 52 with the rotary knob 51. The annular mounting portion 522 is formed with an annular flange 526 allowing the first attracting member 54 to be mounted fixedly therewithin. During assembly of the rotary knob unit 50 and the first handle 41, the connecting portion 523 of the hand-operated connecting rod 52 is moved into the limiting slot 403 in the rotation-limiting portion 40 of the first handle 41 via the first notch 401. Subsequently, the retaining hooks 525 of the hand-operated connecting rod 52 are moved respectively into the hook-engaging slots 515 in the rotary knob 51. As such, the connecting portion 523 is movable between the first end 405 and second end 406 of the limiting slot 403 so that the maximum rotational angle of the hand-operated connecting rod 52 relative to the first handle 41 is 90°. An end of the lock-connecting rod 56 engages fittingly the insert hole 516 in the rotary knob 51 so as to allow for co-rotation with the rotary knob 51. The engaging plate unit 57 is disposed within the second connecting seat 46. The lock-connecting rod 56 is rotatable to activate the engaging plate unit 57 to thereby lock or unlock the electric lock. Since such locking and unlocking operations do not pertain to this invention, a further description thereof will be omitted herein for the sake of brevity. A C-shaped retaining ring 58 is received within the ring-engaging groove unit 404 in the first handle 41 to prevent removal of the first handle 41 from the first lock housing 31.

The electric control mechanism 6 includes a power source unit 61 mounted within the accommodating chamber 312 in the first lock housing 31, a pushbutton unit 62 mounted on the second lock housing 32 and aligned with the pushbutton-receiving holes 324, a positioning seat 63 mounted to the mounting blocks 315 of the first lock housing 31, a clutch gear 64 mounted to the positioning seat 63 and driven by the power source unit 61 to rotate in two directions, a pair of second and third attracting members 65, 65' mounted fixedly to the clutch gear 64 and spaced apart from each other by an angle of 180°, a circuit board 67 mounted to the first lock housing 31, a micro-switch 66 disposed on the circuit board 67, and a sensing switch 68. The power source unit 61 includes a motor 611 disposed in the accommodating space 312 in the first lock housing 31, a worm rod 612 driven by the motor 611, and a reduction gear 613 driven by the worm rod 612. The clutch gear 64 has a meshing portion 641 meshing with the reduction gear 613, a pair of first and second control portions 642, 642' projecting toward the circuit board 67 and each rotatable to contact and activate the micro-switch 66 to thereby stop operation of the power source unit 6, and a central hole 643. The meshing portion 641 has two diametrically opposed mounting holes 644 allowing the second and third attracting members 65, 65' to be mounted respectively therewithin. In this embodiment, the first, second, and third attracting members 54, 65, 65' are magnets. Alternatively, the first attracting member 54 or the second and third attracting members 65, 65' may be made of a magnetically conductive metallic material.

The lock-connecting rod 56 is configured as a plate having a rectangular cross-section.

Figure 4:
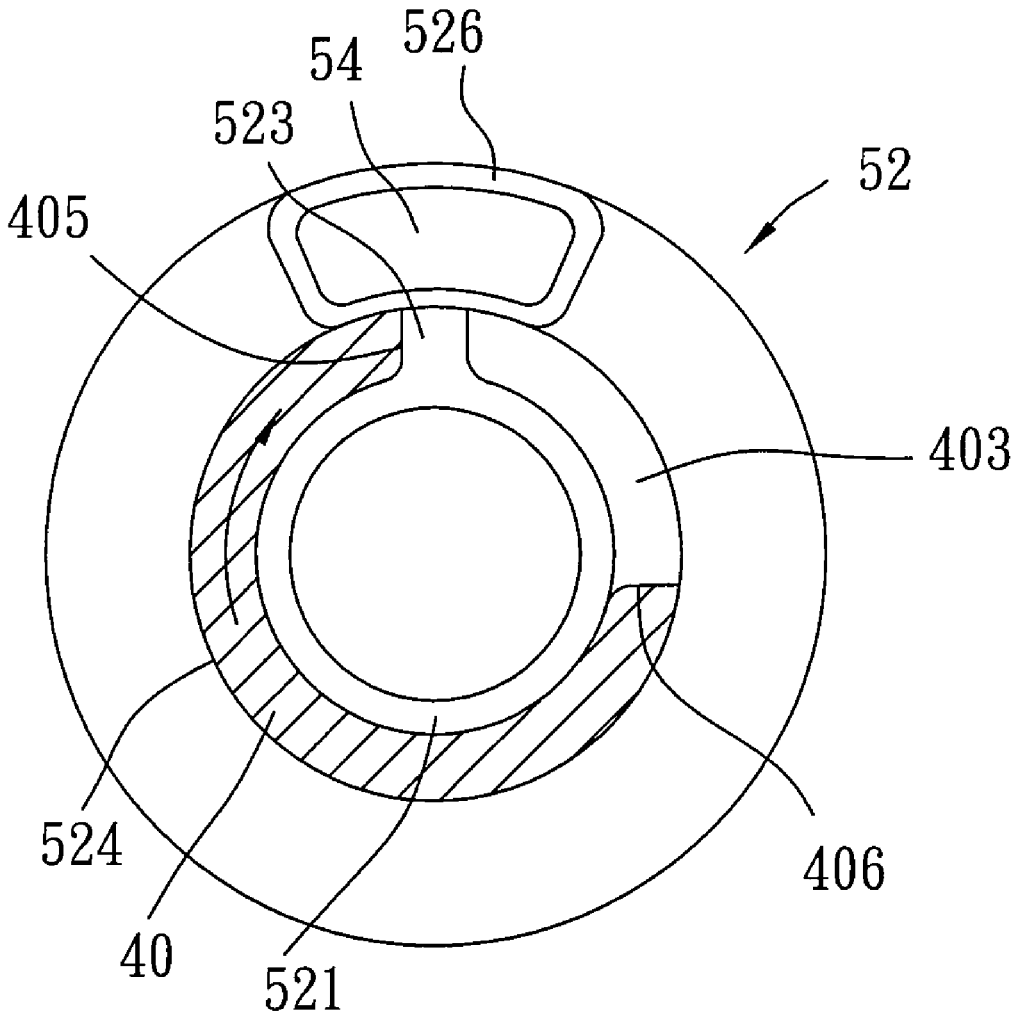
FIG. 4 is a fragmentary schematic side view of the first preferred embodiment, illustrating positioning of the hand-operated connecting rod relative to a first handle when the electric lock is in the unlocking state.
Figure 5:
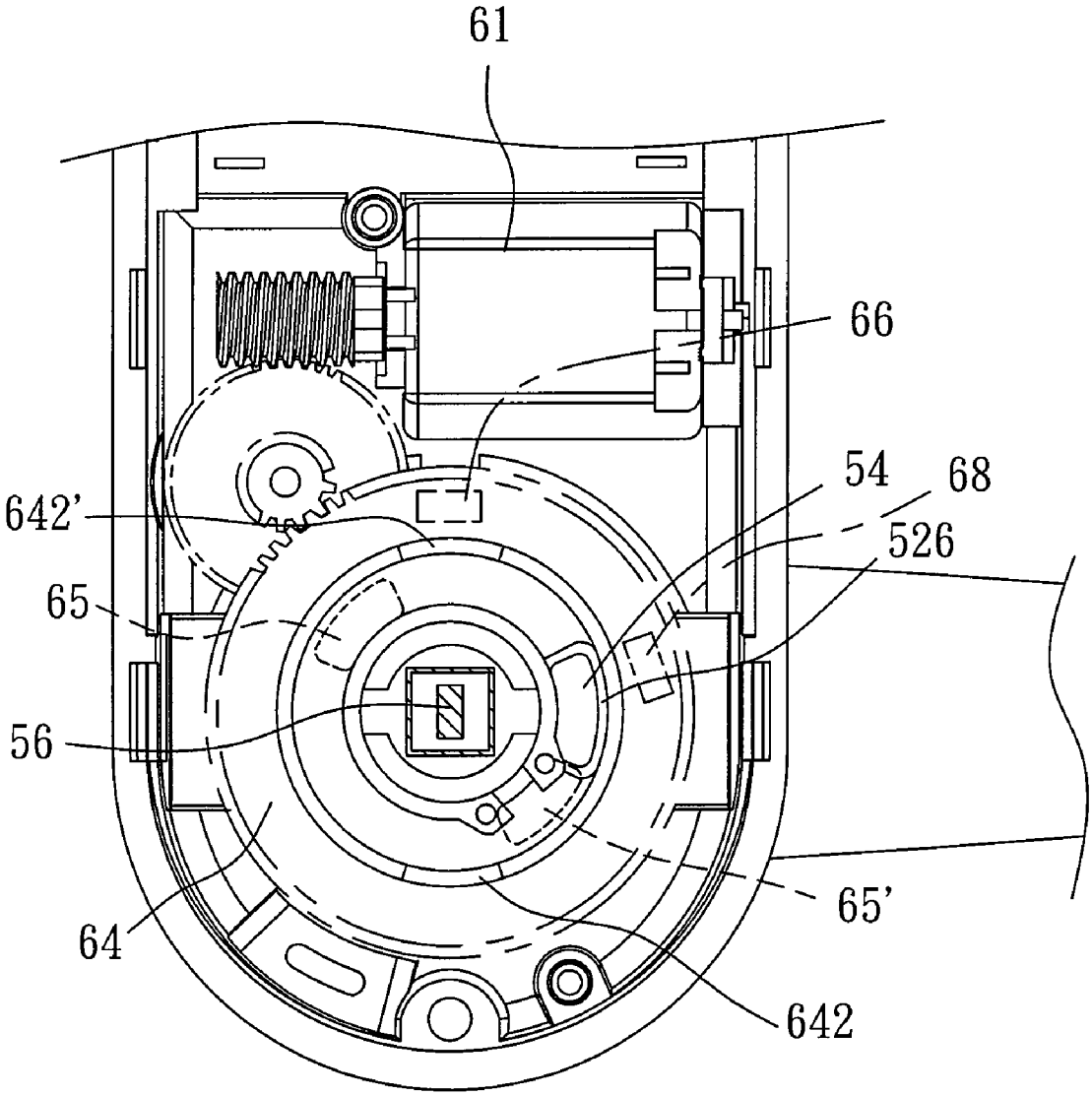
FIG. 5 is a view similar to FIG. 3 but in a locking state.
Figure 6:
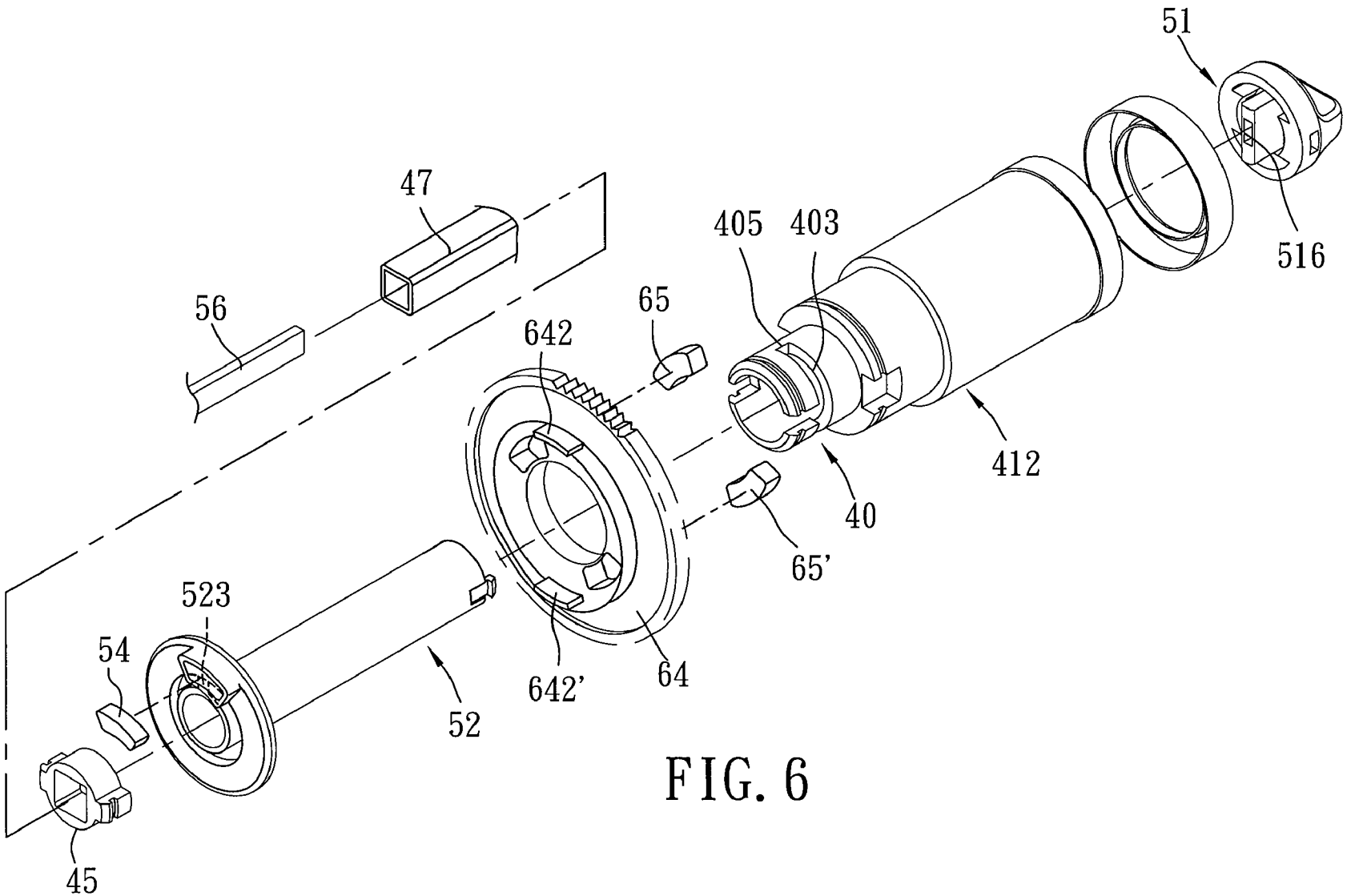
FIG. 6 is a view similar to FIG. 2 but illustrating positioning of the hand-operated connecting rod relative to the rotary knob when the electric lock is in a locking state.
Figure 7:
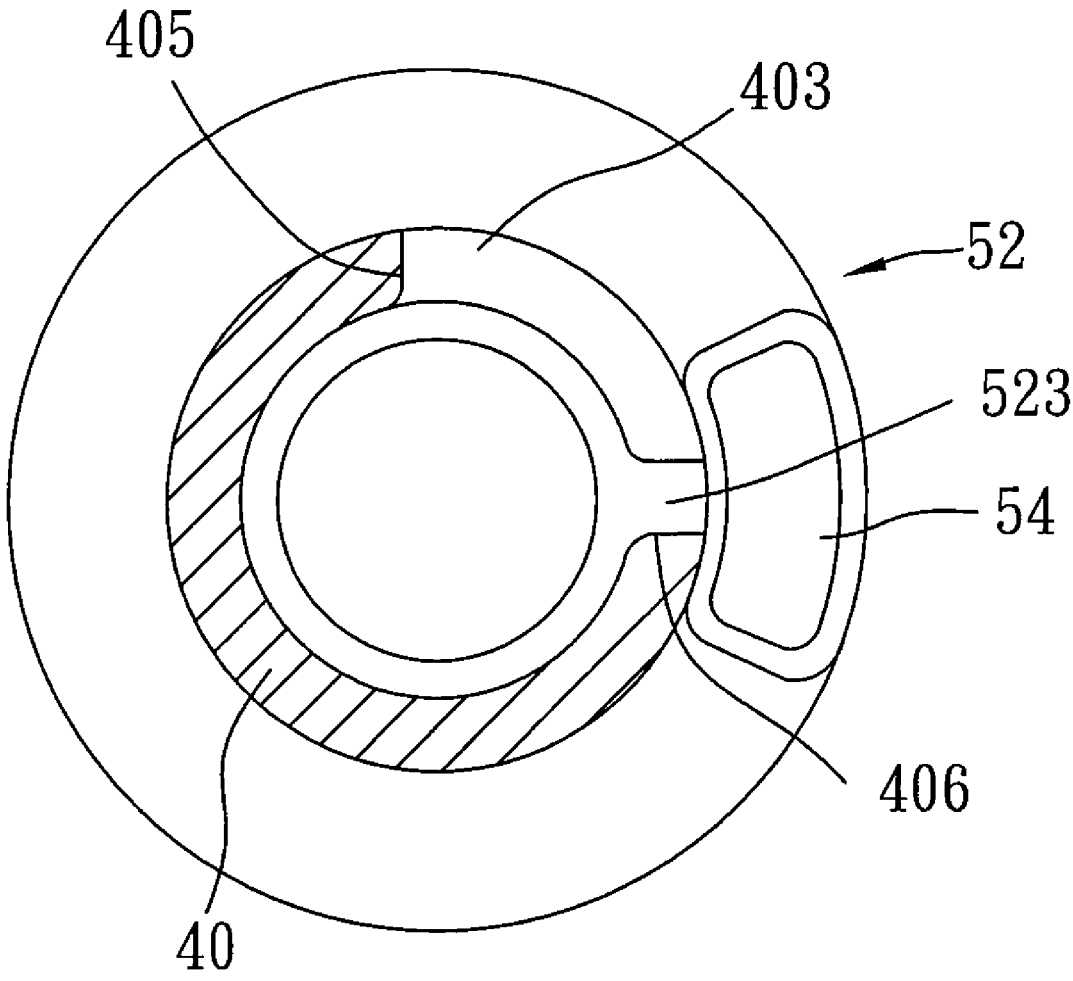
FIG. 7 is a view similar to FIG. 4 but illustrating positioning of the hand-operated connecting rod relative to the first handle when the electric lock is in the locking state.

With further reference to FIGS. 3 and 4, when the electric lock is in an unlocking state, the lock-connecting rod 56 is horizontal, and the connecting portion 523 of the hand-operated connecting rod 52 is disposed at the first end 405 of the limiting slot 403 in the first handle 41. Furthermore, the second attracting member 65 is adjacent to the first attracting member 54, and the first control portion 642 of the clutch gear 64 is aligned with the micro-switch 66. Further, the engaging plate unit 57 projects from the second connecting seat 46 to allow for co-rotation of the second handle 43 with the handle-connecting rod 47. In this state, when an external force is applied to pivot one of the first and second handles 41, 43, the handle-connecting rod 47 and the other of the first and second handles 41, 43 co-rotate therewith to move the spring bolt. When the external force is released, the first and second handles 41, 43 are returned by the return units 44 to their original positions.

With particular reference to FIGS. 1, 5, 6, and 7, the electric lock can be locked manually by rotating the rotary knob 51 or inserting a key (not shown) into the lockset 55 and rotating the key. When the rotary knob 51 is rotated 90°, the hand-operated connecting rod 52 and the lock-connecting rod 56 co-rotate therewith to move the connecting portion 523 of the hand-operated connecting rod 52 to the second end 406 of the limiting slot 403. Hence, the lock-connecting rod 56 is rotated to a vertical position to retract the engaging plate unit 57 into the second connecting seat 46, thereby preventing co-rotation of the second handle 43 with the lock-connecting rod 56 and, thus, opening of the door through operation of the second handle 43. During rotation of the hand-operated connecting rod 52, when the lock-connecting rod 56 is rotated to the vertical position, the first attracting member 54 is aligned with the sensing switch 68 along a longitudinal direction of the hand-operated connecting rod 52. When the sensing switch 68 detects alignment of the first attracting member 54 therewith (i.e., the locking state of the electric lock), a signal is emitted therefrom to the circuit board 67. Hence, if a button-pushing operation is performed on the pushbutton unit 62 in order to lock the door, operation of the power source unit 6 can be prevented.

Alternatively, the electric lock may be locked electrically by operating the pushbutton unit 62 or a remote controller (not shown) to activate the motor 611 of the power source unit 6. When the motor 611 is activated, the clutch gear 64 is rotated clockwise. Upon clockwise rotation of the clutch gear 64 by 45°, the second attracting member 65 comes into alignment with the first attracting member 54 to generate a magnetic attraction force therebetween, to thereby allow for subsequent co-rotation of the hand-operated connecting rod 52 and the rotary knob 51 with the clutch gear 64. When the connecting portion 523 of the hand-operated connecting rod 52 is disposed at the second end 406 of the limiting slot 403, the second control portion 642' contacts and activates the micro-switch 66 to stop operation of the power source unit 61.

To unlock the electric lock electrically, the pushbutton unit 62 or the remote controller is operated to rotate the clutch gear 64 counterclockwise.

To unlock the electric lock manually, the rotary knob 51 is rotated counterclockwise.

Upon counterclockwise rotation of the clutch gear 64 by 45°, the third attracting member 65' comes into alignment with the first attracting member 54 to generate a magnetic attraction force therebetween to thereby allow for subsequent co-rotation of the hand-operated connecting rod 52 and the rotary knob 51 with the clutch gear 64.

Figure 8:
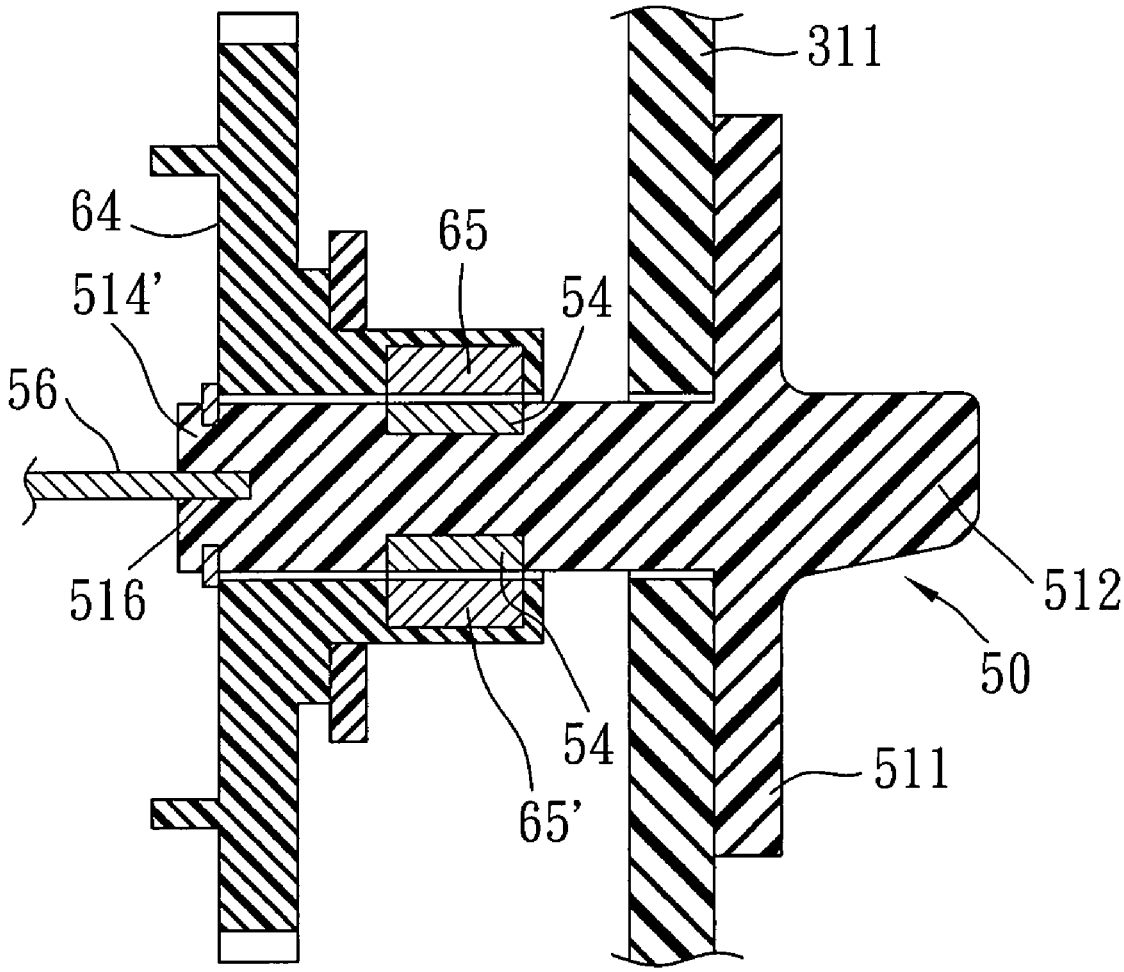
FIG. 8 is a fragmentary sectional view of the second preferred embodiment of an electric lock according to this invention.

FIG. 8 shows the second preferred embodiment of an electric lock according to this invention, which is configured as a so-called "auxiliary lock" (i.e., a lock that does not have any handle) and which is similar in construction to the first preferred embodiment. In this embodiment, the rotary knob unit 50 is one piece configured as a rotary knob, and includes an upright wall 511, an actuation block 512, and a rotating shaft portion having an end surface 514' formed with a cross-shaped slot 516. The cross-shaped slot 516 has two straight slot portions intersecting each other. The lock-connecting rod 56 has an end engaging fittingly one of the straight slot portions of the cross-shaped slot 516 to allow for co-rotation of the lock-connecting rod 56 and the rotary knob unit 50.

Two first attracting members 54 are disposed fixedly on the rotating shaft portion of the rotary knob unit 50, and are spaced apart from each other by an angle of 180°. The clutch gear 64 is sleeved rotatably around the rotating shaft portion of the rotary knob unit 50. The second and third attracting members 65, 65' are disposed fixedly in the clutch gear 64. Each of the second and third attracting members 65, 65' is rotatable relative to the rotary knob unit 50 to align with the corresponding first attracting member 54 along a radial direction of the rotary knob 51.

Since co-rotation of the clutch gear 64 with the rotary knob unit 50 is enabled by a magnetic attraction force generated between the first attracting member(s) 54 and the second and third attracting members 65, 65', no friction occurs among rotating parts of the electric lock. As a result, wearing of the rotating parts can be prevented, thereby increasing the service life of the electric lock and precision in controlling locking and unlocking of the electric lock.

With this invention thus explained, it is apparent that numerous modifications and variations can be made without departing from the scope and spirit of this invention. It is therefore intended that this invention be limited only as indicated by the appended claims.

I claim:

1. An electric lock comprising:

a manual operation mechanism including a rotary knob unit, a first attracting member mounted fixedly to said rotary knob unit, a key-operated lockset, and a lock-connecting rod connected to and rotatable by said rotary knob unit and said key-operated lockset;

an electric control mechanism including a power source unit, a clutch gear driven by said power source unit to rotate in two directions, and a second attracting member mounted fixedly to said clutch gear; and a lock housing unit for mounting with said electric control mechanism, and a handle unit mounted on said lock housing unit, said handle unit including a first handle disposed rotatable on said lock housing unit and allowing said rotary knob unit to be mounted rotatably thereon, and a second handle disposed rotatable on said lock housing unit and allowing said key-operated lockset to be mounted thereon;

wherein, when said clutch gear is driven by said power source unit to rotate to align said first and second attracting members with each other, a magnetic attraction force is generated between said first and second attracting members to allow for co-rotation of said rotary knob unit with said clutch gear;

wherein, said first handle has a rotation-limiting portion formed with at least one notch and a circumferentially extending limiting slot that has a first end and a second end in spatial communication with said notch; and said rotary knob unit includes a rotary knob, and a hand-operated connecting rod, said hand-operated connecting rod having a handle-retaining portion connected to and co-rotatable with said rotary knob, an annular mounting portion disposed around said handle-retaining portion and allowing said first attracting member to be mounted thereon, and a connecting portion interconnecting said handle-retaining portion and said mounting portion, said connecting portion being received movably within said limiting slot in said first handle and movable between said first end and said second end so that a maximum rotational angle of said hand-operated connecting rod relative to said first handle is 90°, said notch in said first handle allowing said connecting portion to be moved into said limiting slot therethrough.

2. The electric lock as claimed in claim 1, wherein said electric control mechanism further includes a third attracting member mounted fixedly to said clutch gear and spaced apart from said second attracting member by an angle of 180 degrees, a magnetic attraction force being generated between said first and third attracting members to thereby allow for co-rotation of said rotary knob unit with said clutch gear when said clutch gear is driven by said power source unit to rotate to align said first and third attracting members with each other.

3. The electric lock as claimed in claim 1, wherein said rotary knob includes a disc portion, an actuation block projecting from said disc portion and allowing for manual operation, and a surrounding wall extending from said disc portion away from said actuation block and having a hook-engaging slot formed radially therethrough, said handle-retaining portion of said hand-operated connecting rod being formed with a retaining hook engaging said hook-engaging slot in said rotary knob so as to allow for co-rotation of said hand-operated connecting rod with said rotary knob.

4. The electric lock as claimed in claim 1, wherein said first handle is formed with two said notches, said handle unit further including a first connecting seat, and a handle-connecting rod extending through and co-rotatable with said first connecting seat, said first connecting seat being formed with two wings engaging respectively said notches in said first handle so as to allow for co-rotation with said first handle.

5. The electric lock as claimed in claim 1, wherein said first and second attracting members are rotatable relative to each other to align with each other along a longitudinal direction of said hand-operated connecting rod.

6. The electric lock as claimed in claim 1, wherein said electric control mechanism further includes a circuit board provided with a micro-switch, said power source unit including a motor and a reduction gear driven by said motor, said clutch gear having a meshing portion meshing with said reduction gear, and a control portion rotatable to activate said micro-switch to thereby stop operation of said power source unit.

7. The electric lock as claimed in claim 1, wherein said clutch gear is disposed rotatably around said rotary knob unit, said first and second attracting members being rotatable relative to each other to align with each other along a radial direction of said rotary knob unit.

* * * * *